United States Patent [19]

Kim

[11] 3,937,193

[45] Feb. 10, 1976

[54] ELECTRONIC IGNITION SYSTEM

[75] Inventor: Soo Nam Kim, Detroit, Mich.

[73] Assignee: Ford Motor Company, Dearborn, Mich.

[22] Filed: Nov. 19, 1973

[21] Appl. No.: 417,443

[52] U.S. Cl. ..... 123/117 R; 123/148 E

[51] Int. Cl.[2] ..... F02P 5/04

[58] Field of Search ..... 123/148 R, 148 OC, 146.5, 123/117 R

[56] References Cited

UNITED STATES PATENTS

| | | | |
|---|---|---|---|
| 3,559,629 | 2/1971 | Sauvignet | 123/117 R |
| 3,605,713 | 9/1971 | Le Masters | 123/148 E |
| 3,705,573 | 12/1972 | Palazzetti | 123/148 E |
| 3,831,570 | 8/1974 | Compton | 123/148 E |
| 3,831,571 | 8/1974 | Weber | 123/148 E |
| 3,890,944 | 6/1975 | Werner | 123/117 R |

*Primary Examiner*—Charles J. Myhre
*Assistant Examiner*—Ronald B. Cox
*Attorney, Agent, or Firm*—Robert W. Brown; Keith L. Zerschling

[57] ABSTRACT

An electronic ignition system for a spark-ignition internal combustion engine. The ignition system is of the inductive type and includes an ignition coil having at least a primary winding and a switching device connected in series with it to control its current. An electrical signal is generated having a period equal to the period of the ignition cycle of the engine. This electrical signal is used to control at least one constant current source and a constant current drain coupled to at least one capacitor. The charging and discharging of this capacitor determines the initiation of current in the ignition coil primary winding and determines the length of time current is present in the ignition coil primary winding during each ignition cycle. The ignition system provides substantially constant dwell time, as distinguished from dwell angle, limits ignition coil primary current to a predetermined maximum level, and prevents ignition coil primary current when engine speed is less than a predetermined level or equal to zero.

12 Claims, 4 Drawing Figures

ELECTRONIC IGNITION SYSTEM

BACKGROUND OF THE INVENTION

This invention relates to an electronic ignition system for a spark-ignition internal combustion engine and, more particularly, relates to a solid state ignition system capable of providing substantially constant dwell time, as distinguished from dwell angle, over a range of engine speeds. At speeds in excess of this range, the ignition system provides a dwell time which gradually decreases but which remains very satisfactory for most motor vehicle applications of spark-ignition internal combustion engines. The ignition system of the invention also provides circuitry for limiting the current in the ignition coil primary winding to a predetermined maximum level.

Recently, it has become desirable to provide an electronic ignition system for spark-ignition internal combustion engines wherein the energy supplied to the spark plugs on the secondary side of the ignition coil is at a higher level than in conventional ignition systems. Moreover, it has become desirable to provide a higher ignition coil secondary voltage level. In conventional ignition systems, which utilize breaker points to control current in the ignition coil primary winding, and in most presently available electronic ignition systems, this is either impractical or impossible.

To facilitate an understanding of the present invention, it is desirable to define certain terms used herein. Thus, for the purposes of the present invention, the term "ignition cycle" refers to the time period between consecutive firings or spark discharges of an internal combustion engine ignition system. The term 'dwell time" refers to the time, expressed in units of time, during which a current, other than leakage current if any, is present in the ignition coil primary winding. The term "dwell angle" is expressed in angular units and represents the fraction or angular portion of the ignition cycle represented by the dwell time. Thus, an ignition system which provides a constant dwell time has a dwell angle which varies with engine speed, and conversely, an ignition system which provides a constant dwell angle over a range of engine speeds has a variable dwell time over such range of engine speeds.

Conventional ignition systems typically provide a constant dwell angle. This results from the fact that such systems utilize breaker points controlled by a cam driven by the engine distributor. The cam causes the breaker points, which are connected in series with the ignition coil primary winding, to remain open for a predetermined substantially constant angle of rotation of the distributor shaft. Such a conventional system has a variable dwell time because the breaker points are closed for a considerable length of time at low engine speeds and, as engine increases, the length of time the points remain closed decreases due to the greater angular velocity of the distributor shaft. Most of the previously proposed inductive electronic ignition systems for internal combustion engines have provided constant dwell angle.

In an inductive ignition system, it is necessary to establish a predetermined current in the ignition coil primary winding to insure adequate sparking potential on the secondary of the ignition coil. Since this current is established by turning on a switch that permits electrical charge to flow through the ignition coil primary winding, the length of time required to establish the predetermined necessary current is determined by the resistance-inductance circuit of the ignition coil primary winding. Once an electrical potential is applied to the ignition coil primary winding, the current exponentially builds up, in the manner for an inductive circuit, to a certain level and, with respect to the generation of a high potential on the secondary of the ignition coil, little is gained by permitting this current to continue for a greater length of time. Moreover, continuance of this current once it has reached a certain level results in a significant waste of power of the source of electrical energy. Also, it can cause overheating of the ignition coil or, were higher ignition coil secondary voltages and energy levels to be provided, require an unduly large ignition coil and other ignition system components. Thus, it is desirable to provide a constant dwell time in an ignition system, a dwell time sufficient only to permit the ignition system primary current to achieve a predetermined satisfactory level sufficient to produce an adequate sparking potential and to produce such sparking potential as soon as practicable after this predetermined current level has been achieved in the ignition coil primary winding. An ignition system capable of providing this type of operation is described in U.S. Pat. No. 3,605,713 issued Sept. 20, 1971, to P. D. Le Masters et al. The present invention provides a similar result, but achieves that result in a substantially different manner than that described in U.S. Pat. No. 3,605,713.

SUMMARY OF THE INVENTION

In accordance with the present invention, an electronic ignition system for a spark-ignition internal combustion engine includes means for generating a periodic electrical signal in timed relation to engine operation, the period of the electrical signal being equal to the ignition cycle period, and means for generating a linearly varying electrical voltage signal which begins at a predetermined angular point in each cycle of the periodic electrical signal. This linearly varying electrical voltage continues until a fixed threshold level is reached at which instant the ignition system dwell time begins. At the end of the dwell time, a switching device connected in series with the ignition coil primary winding is rendered nonconductive, thereby, to generate a high voltage in the ignition coil secondary winding and to produce a spark in a spark gap. The dwell time is substantially constant over a range of engine speeds.

The linearly varying voltage begins at an angular point in the ignition cycle which is the same for each cycle, but the magnitude of the voltage at this point is inversely proportional to engine speed. The linearly varying voltage is achieved with the use of a capacitor coupled to a first current source and a current drain. During a fractional portion of the ignition cycle and of the periodic electrical signal, the capacitor is charged from the first constant current source. The fraction, or, angular amount, of the periodic electrical signal during which the first capacitor is charged is a constant regardless of engine speed. However, variations in engine speed necessarily affect the amount of charge accumulated in the capacitor, this being inversely proportional to engine speed, and the voltage on the capacitor therefore is inversely proportional to engine speed. At the end of the constant fractional period of the periodic electrical signal during which the capacitor is charged, the capacitor then is permitted to discharge through the constant current drain. When the capacitor voltage is at the aforementioned threshold level, the constant dwell time is initiated.

In order to generate an electrical signal which can be used to control the time of charging of the first capacitor from the first constant current source, it is desirable to generate a periodic electrical signal having a first portion corresponding to the fixed fractional or angular interval during which the first capacitor is to be charged from the first constant current source. This is accomplished with the use of a second capacitor which is charged in a first direction from a second constant current source and which, thereafter, is charged in the opposite direction from a third constant current source. The third constant current source may produce a current greater in magnitude than that produced by the second constant current source.

The invention further provides circuit means for limiting current in the ignition coil primary winding to a predetermined maximum level. Also, circuitry is provided for preventing the presence of current in the ignition coil primary winding when the engine is operating at less than a predetermined speed including zero.

The invention may be better understood by reference to the detailed description which follows and to the drawings.

DETAILED DESCRIPTION OF THE INVENTION

Figure 1:
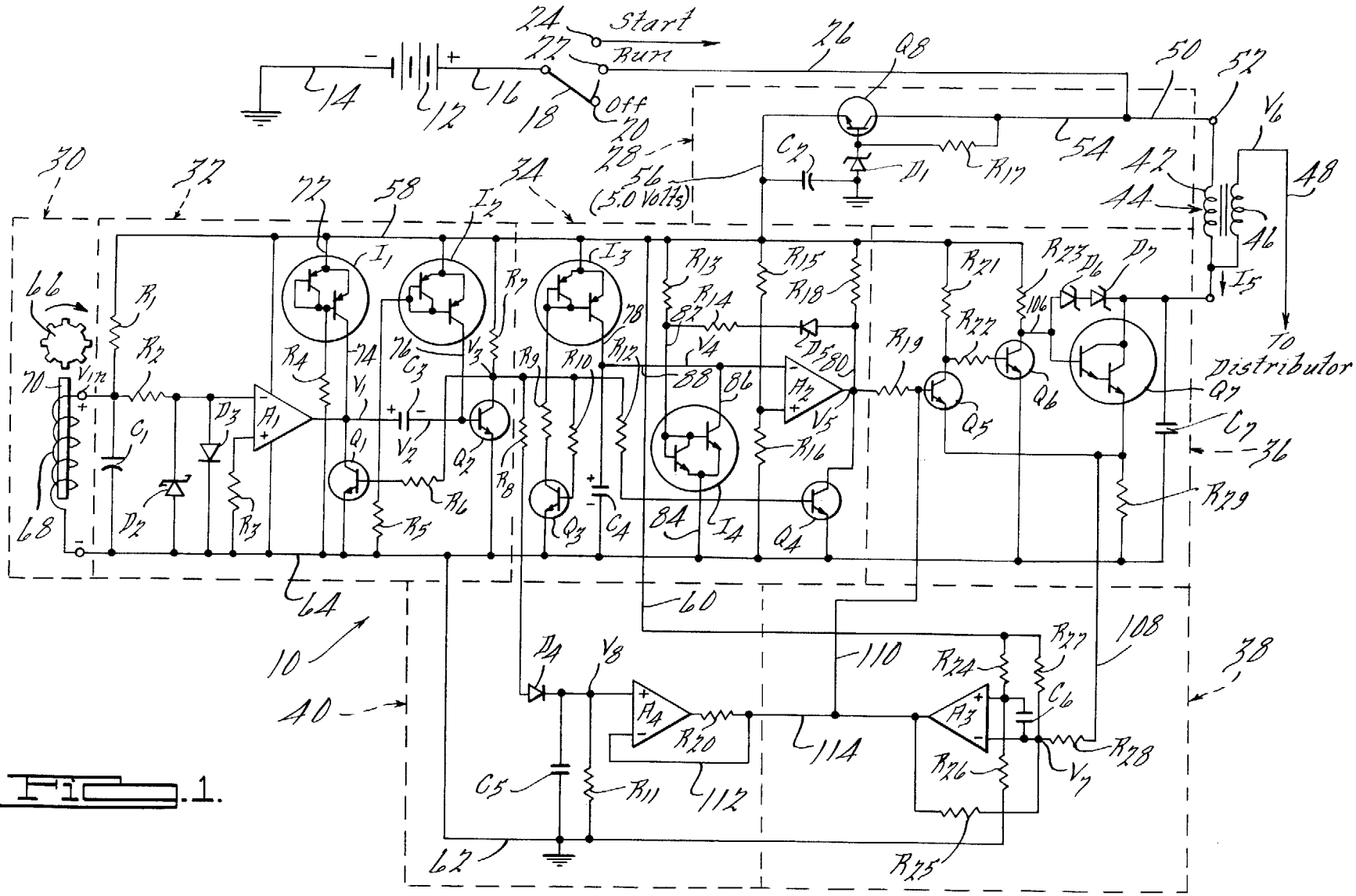
FIG. 1 is a schematic diagram of the electronic ignition system of this invention in its presently preferred form.

With reference now to the drawings, there is shown a circuit for an electronic ignition system, generally designated by the numeral 10, for a spark-ignition internal combustion engine. The circuit includes a DC source of electrical potential 12, which preferably is a 12-volt storage battery, having its negative terminal 14 connected to ground and having its positive terminal 16 connected to an ignition switch 18. The ignition switch 18 has an "off" terminal 20, a "run" terminal 22 and a "start" terminal 24. When the ignition switch 18 is in the "run" position, electrical potential is supplied to a line 26. Electrical potential is also supplied to this line 26 when the ignition switch is in the start position. When the ignition switch 18 is in the start position, DC electrical potential is supplied to the engine starting system (not shown) to crank the engine.

The electronic ignition system 10 includes an input circuit 30 for generating a periodic electrical signal $V_{in}$ having a period equal to the ignition cycle of the engine. The ignition system 10 also includes circuitry 32 for generating an electrical signal which has a first portion and a second portion, the first portion being indicative of a predetermined fraction, or angular amount, of the periodic electrical signal produced by the input circuit 30. The constant-angle-generating circuit 32 produces voltage signals $V_1$, $V_2$, and $V_3$ corresponding to the waveforms similarly designated in FIG. 2.

The output $V_3$ of the constant-angle-generating circuit 32 is supplied to a constant-dwell-time-generating circuit 34 which produces an electrical signal $V_4$ that determines ignition system dwell time. By proper selection of circuit component values, the dwell time may be made constant over a range of engine speeds. The output $V_5$ of the dwell-time-generating circuit 34 is applied to ouput circuitry 36 which includes a solid-state switching device that is connected in series with the primary winding 42 of an ignition coil 44. When used in an ignition system for a multi-combustion-chamber engine, the secondary winding 46 of the ignition coil may be connected in the usual manner to a high voltage distributor (not shown) for supplying sparking potential $V_6$ sequentially to the various engine spark plugs.

Circuitry 38 is provided to limit current in the ignition coil primary winding 42 to a predetermined maximum value. A current-interrupter circuit 40 is provided for the purpose of preventing current flow in the ignition coil primary winding 42 when the speed of the engine crankshaft is below a predetermined level including zero. This circuit prevents the waste of electrical energy and heating of the ignition coil and other circuit components when the engine is, for example, not in operation at a time when the ignition switch is in the run position, as might occur when the engine stalls or when the ignition switch for other reasons is left in the run position for considerable time intervals.

The ignition system 10 includes a voltage-regulator circuit 28 which is supplied with DC electrical potential occurring on the lead 26. This DC electrical potential is applied via a lead 50 directly to the upper terminal 52 of the ignition coil primary winding 42, and it is applied via a lead 54 to the collector electrode of a transistor $Q_8$ in the voltage-regulator circuit 28. A voltage divider comprising a resistor $R_{17}$ and a zener diode $D_1$ is connected between the lead 54 and ground. The common connection between the cathode of the zener diode $D_1$ and the resistor $R_{17}$ is connected to the base of the transistor $Q_8$ to provide its base drive. The zener diode $D_1$ preferably has a nominal reverse-breakdown voltage of 5.6 volts. Thus, the lead 56 connected to the emitter of the transistor $Q_8$ has a DC potential, regulated by the zener diode $D_1$, of about 5.0 volts due to the base-emitter voltage drop of the transistor $Q_8$. This DC voltage is smoothed by a filter-capacitor $C_2$ connected between the lead 56 and ground. The low and regulated DC voltage on the lead 56 is applied to a lead 58 supplying the circuits 32, 34 and 36. This regulated voltage appearing on the lead 58 also is supplied via a lead 60 to the circuit 38. The ground reference potential for the circuits 30, 32, 34, 36, 38 and 40 is established by leads 62 and 64.

Figure 2:
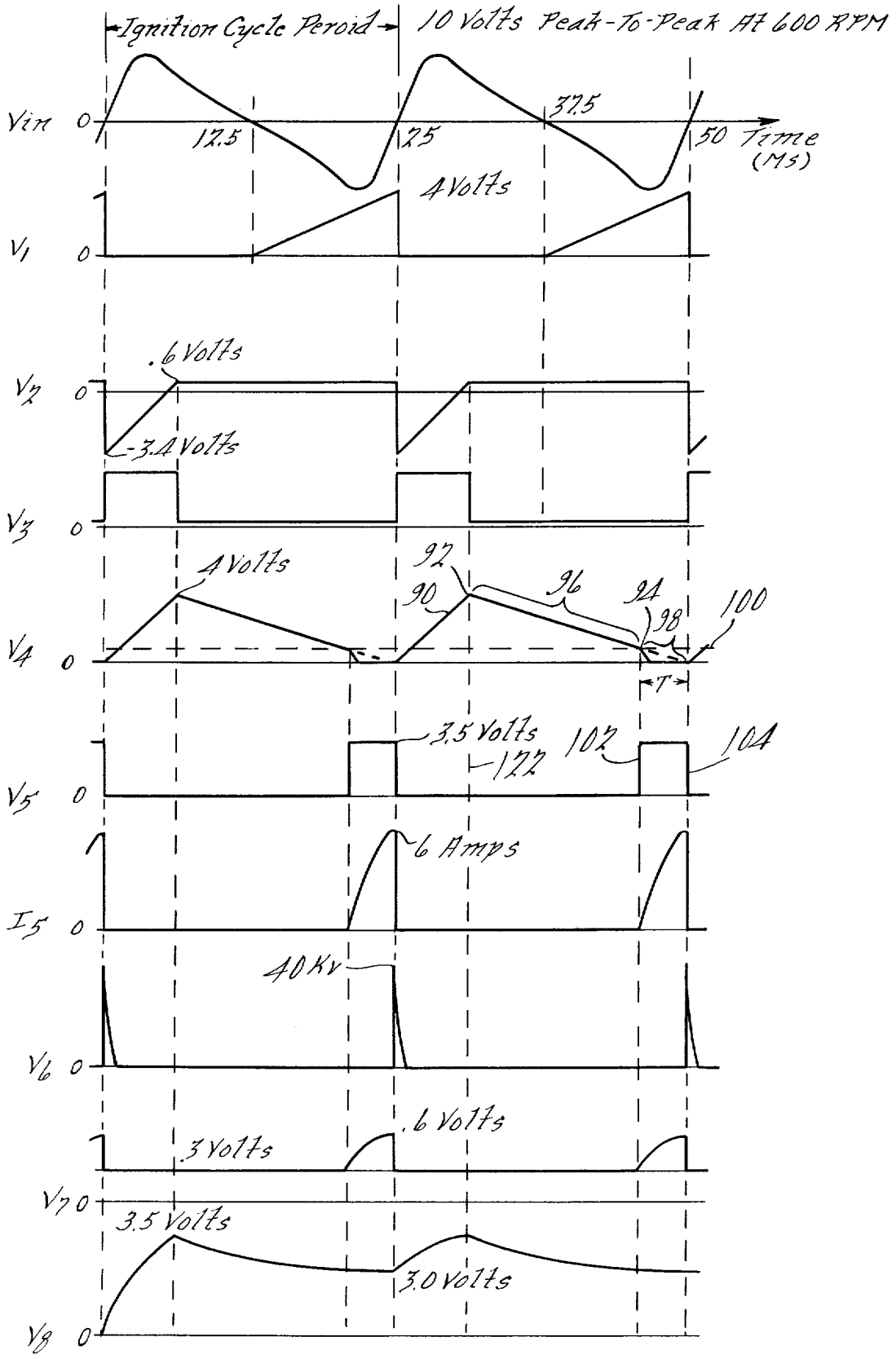
FIG. 2 is a diagram of various voltage waveforms and a current waveform which occur at various points in the circuit schematically illustrated in FIG. 1 and represents such waveforms as they appear at an engine operational speed of about 600 rpm, a typical idle speed; the voltage waveforms are referenced to ground potential.

Although it is not essential, preferably the circuitry 30 for generating a periodic electrical signal having a period equal to the ignition cycle of the engine comprises a magnetic pulse generator having a rotating toothed-wheel 66 located in proximity to a pickup coil 68 having a magnetic circuit pole-piece 70. The toothed-wheel 66 has as many teeth as there are combustion chambers in the engine to be supplied with sparks. In an eight-cylinder, reciprocating, four-cycle internal combustion engine, the toothed-wheel 66 has eight teeth and is driven by the engine camshaft which operates at one-half the engine crankshaft speed. As each tooth is driven past the pole-piece 70, an alternating voltage signal $V_{in}$ is generated having a period equal to the ignition cycle of the engine. A magnetic pulse generator suitable for use as the circuitry 30 and preferred is described in U.S. Pat. application Ser. No. 316,945 filed Dec. 20, 1972, in the name of C. C. Kostan and entitled "Signal Generating Mechanism", now U.S. Pat. No. 3,783,314. This signal generating mechanism or magnetic pickup device produces the voltage waveform $V_{in}$ across the terminals of the pickup coil 68, one terminal of which is connected to the ground lead 64 and the other terminal of which forms the input to the circuitry 32. The voltage $V_{in}$ is shown in FIG. 2. It should be noted at this time that all of the voltage waveforms in FIG. 2, which occur at various points in the ignition system 10, are with respect to ground potential. Also, the waveforms are for a four-cycle, eight-cylinder engine operating at 600 rpm, an engine speed at which the ignition cycle period is 25 milliseconds.

The circuitry 32 for generating an electrical signal having a portion thereof indicative of a constant angle or fraction of the input signal $V_{in}$ includes a comparator $A_1$ which has its negative or inverting input supplied with the electrical signal $V_{in}$ through an input resistor $R_2$. The positive input to the comparator $A_1$ is connected to ground through an input resistor $R_3$. A Schottky diode $D_2$ has its cathode connected to the negative input to the comparator $A_1$ and has its anode connected to ground lead 64. A diode $D_3$ has its anode connected to the negative input to the capacitor and has its cathode connected to ground. A filter capacitor $C_1$ is connected in parallel with the pickup coil 68. A constant current source $I_1$, which consists of two PNP transistors, has the emitters of these two transistors connected together and connected to the low-voltage supply lead 58 by a lead 72. The base electrodes of the two transistors are connected together, the collector lead of one of the transistors is connected to the commonly-connected transistor bases, and these common connections are connected through a resistor $R_4$ to the ground lead 64. The collector of one of these current-source transistors is connected by a lead 74 to the output of the comparator $A_1$ and to the collector electrode of a transistor $Q_1$ the emitter of which is connected to the ground lead 64.

The base of the transistor $Q_1$ is connected through a current-limiting resistor $R_6$ to a junction point, at which the voltage signal $V_3$ occurs, formed between a resistor $R_7$ and the collector electrode of a transistor $Q_2$ the emitter of which is connected to the ground lead 64. The base of the transistor $Q_2$ is connected by a lead 76 to the collector electrode of one of the two PNP transistors in another constant current source $I_2$. The constant current source $I_2$ is connected in a manner similar to that used for the constant current source $I_1$ and has the bases of its two transistors connected together and to the ground lead 64 through a resistor $R_5$. The current sources $I_1$ and $I_2$ are coupled to opposite ends of a capacitor $C_3$, one end of this capacitor $C_3$, at which the voltage signal $V_1$ occurs, being connected to the output of the comparator $A_1$ and the other end of this capacitor $C_3$, at which the voltage $V_2$ occurs, being connected to the base of the transistor $Q_2$.

The constant current generator $I_1$ produces a fixed current through the resistor $R_4$. It can be shown mathematically that the current generator $I_1$ produces a current in the lead 74 very nearly equal to the current through the resistor $R_4$. Similarly, the constant current generator $I_2$ produces a current in its lead 76 that is equal to the current continuously present in the resistor $R_5$. Preferably, the current through the lead 76 of the constant current generator $I_2$ is twice as great as the current produced in the lead 74 by the constant current generator $I_1$.

The function of the comparator $A_1$ is to detect the zero-crossing points, both positive-going and negative-going, of the input waveform $V_{in}$. The comparator $A_1$ preferably is an integrated circuit which has at its output a switching transistor which produces an open circuit condition at the comparator output when the signal applied to its negative input is more negative than the signal applied to its positive input. On the other hand, when the signal applied to the comparator negative (inverting) input is more positive than the signal applied to the comparator positive input, then the comparator output is at substantially ground potential.

The magnetic pickup coil 68 has one of its terminals connected through the input resistor $R_3$ to the positive input to the comparator $A_1$. Thus, this pickup coil terminal and the positive input to the comparator are at a reference ground potential. When the upper terminal of the pickup coil 68 is positive with respect to its lower terminal, then this voltage produces a current through the input resistor $R_2$ and the diode $D_3$. Thus, as soon as the signal $V_{in}$ crosses zero or ground potential in the positive-going direction, a positive voltage appears at the negative input to the comparator $A_1$, this input being positive with respect to the ground potential appearing at the reference or positive input to the comparator $A_1$, and the comparator output goes to ground potential. The diode $D_3$ limits the voltage appearing at the negative input of the comparator to the diode drop, approximately 0.6 volts. When the signal $V_{in}$ crosses zero in the negative-going direction, current flows through the diode $D_2$ and the resistor $R_2$, in the opposite direction than previously described, and the negative input to the comparator $A_1$ is negative with respect to the reference ground potential applied to its positive input. Therefore, the comparator output becomes an open circuit condition. The Schottky diode $D_2$ limits the voltage at the negative input to the comparator $A_1$ to approximately −0.4 volts.

Immediately prior to the time at which the comparator output becomes an open circuit, the transistor $Q_2$ is conductive and the voltage $V_2$ at its base is equal to the base-emitter drop of the transistor $Q_2$, a voltage of about 0.6 volts. When the comparator $A_1$ output voltage becomes an open circuit at the negative-going zero-crossing point of the voltage $V_{in}$, the constant current source $I_1$ supplies its constant current through the lead 74 to the capacitor $C_3$ charging it to the polarity indicated in FIG. 1, this current flowing through the base-emitter junction of the transistor $Q_2$. The capacitor $C_3$ charges linearly to produce the linearly increasing portion of the voltage $V_1$ which portion continues as long as the output of the comparator $A_1$ remains an open circuit. The voltage $V_2$ at the opposite terminal of the capacitor $C_3$ remains at 0.6 volts during this time. When the comparator $A_1$ output voltage goes to ground potential at the positive-going zero-crossing point of the input voltage $V_{in}$, the the voltage $V_1$ suddenly goes to this ground potential which forces its opposite terminal, where the signal $V_2$ occurs, to drop to about −3.4 volts it being assumed in this case that the engine is operating at about 600 rpm and that the linearly varying voltage at $V_1$ has increased to about 4 volts. When the voltage $V_2$ becomes negative with respect to ground potential, the transistor $Q_2$ turns off and the voltage $V_3$, which is the output of the circuitry 32, suddenly rises to a level near the low voltage supply of 5.0 volts. The transistor $Q_1$ becomes fully conductive and, simultaneously, the capacitor $C_3$ begins to charge in the opposite direction from the constant current source $I_2$, which produces in its lead 76 a constant current twice that produced by the constant current source $I_1$. The $I_2$ current flows through the lead 76, through the capacitor $C_3$ and through the collector-emitter circuit of the transistor $Q_1$. This charging of the capacitor $C_3$ in the reverse direction produces the saw-toothed first portion of the $V_2$ waveform shown in FIG. 2. The voltage $V_2$ linearly increases with a slope twice as great as that in the linearly increasing portion of the voltage waveform $V_1$ because the constant current produced by the constant current generator $I_2$ is twice as great as that produced by the current generator $I_1$. The voltage $V_2$ rises to 0.6 volts, the base-emitter drop of the transistor $Q_2$, in a time interval equal to one-half that which is required to charge the capacitor $C_3$ from the constant current source $I_1$.

Since the capacitor $C_3$ when being charged from the constant current source $I_1$ receives a constant current during an interval equal to the time between zero-crossing points of the input signal $V_{in}$ and since a zero-crossing point occurs at the end of each half-cycle of the input signal $V_{in}$, then the time required to charge the capacitor $C_3$ in the opposite direction from the current source $I_2$ is always equal to one-quarter or twenty-five percent of the periodic electrical input signal $V_{in}$ produced in the pickup coil 68 of the magnetic pulse generator.

When the signal $V_2$ reaches 0.6 volts, the transistor $Q_2$ becomes conductive and the voltage $V_3$ decreases to the saturation level of the transistor $Q_2$. Thus, the voltage signal $V_3$ is a periodic signal having a first portion comprising a pulse having a duration equal to one-quarter or twenty-five percent, a fixed fraction, of the period of the electrical input signal $V_{in}$. Variations in engine speed will not change this fractional relationship of the first portion of the signal $V_3$ to the period of the input signal $V_{in}$. Thus, the circuitry 32 produces an electrical signal having a constant angle, that is, 90° of the periodic input signal.

When the transistor $Q_2$ becomes conductive as described above, the transistor $Q_1$ becomes nonconductive as initially assumed in this description. The transistor $Q_1$ prevents input transient voltages from affecting the charging of the capacitor $C_3$ from the current generator $I_2$.

The circuit 34 for generating a constant dwell time electrical signal includes a constant current source $I_3$ which comprises two PNP transistors connected as are the transistors in the current sources $I_1$ and $I_2$. The constant current source $I_3$ produces a current in a resistor $R_9$ when the collector-emitter output circuit of a transistor $Q_3$ is conductive. The current in the collector lead 78 of the current source $I_3$ is constant and very nearly equal to the current in the resistor $R_9$. The base of the transistor $Q_3$ is connected through a resistor $R_{10}$ to the collector of the transistor $Q_2$ at which the voltage signal $V_3$ appears. The signal $V_3$ is also applied through a resistor $R_{12}$ to the base electrode of a transistor $Q_4$. The emitter of the transistor $Q_4$ is connected to ground and its collector is connected to the output of a comparator $A_2$. The comparator output is connected by a lead 80 to the junction formed between the anode of a diode $D_5$ and one terminal of a resistor $R_{18}$. The other terminal of the resistor $R_{18}$ is connected to the low-voltage supply lead 58. The cathode of the diode $D_5$ is connected through a resistor $R_{14}$ to one terminal of a resistor $R_{13}$ the other terminal of which is connected to the low-voltage supply lead 58. The junction formed between the resistors $R_{13}$ and $R_{14}$ is connected by a lead 82 to the commonly-connected bases of a pair of NPN transistors in a constant current drain $I_4$. The two NPN transistors in the constant current drain $I_4$ have their emitters connected together and connected by a lead 84 to the ground lead 64. The collector of one of the NPN transistors is connected to the commonly-connected bases of the transistors and the collector of the other transistor is connected by a lead 86 to the negative input of the comparator $A_2$. The constant current drain $I_4$ thus is connected such that the current in its lead 86 is very nearly equal to the current in its lead 82. Preferably, the constant current $I_3$ produced in the lead 78 is slightly less than or equal to four times the constant current $I_4$ in the lead 86 of the current drain. The lead 86 is connected by a lead 88 to one terminal of a capacitor $C_4$. The lead 78 from the constant current source $I_3$ is also connected to this capacitor terminal. The other terminal of the capacitor $C_4$ is connected to the ground lead 64.

In the operation of the constant dwell time circuitry 34, the transistor $Q_3$ is rendered fully conductive when the periodic electrical signal $V_3$ rises to its high-level voltage at the beginning of the first portion, or, constant angle portion, of this waveform. This causes the current source $I_3$ to produce its constant current in the lead 78. Approximately three-fourths of this $I_3$ current flows into the capacitor $C_4$ charging it to the indicated polarity; the remainder of the current $I_3$, an amount equal to the constant drain current $I_4$, flows through the lead 88 and the lead 86 to ground. Thus, the capacitor $C_4$ is charged linearly, at a constant rate, for the constant angle time, twenty-five percent of the $V_{in}$ periodic input signal, at the end of which time it will have achieved a voltage level which is inversely proportional to engine speed and which, at about 600 rpm, may be about 4.0 volts. When the first portion of the constant angle $V_3$ ends and the voltage $V_3$ becomes a low level of about 0.1 volts, then the transistor $Q_3$ becomes nonconductive and the capacitor $C_4$ begins to discharge through the lead 88 and the lead 86 of the constant current drain $I_4$, this discharge being at the fixed current rate of $I_4$. The voltage $V_4$ which appears at the terminal of the capacitor $C_4$ designated positive is shown in FIG. 2. It may be seen that the waveform $V_4$ has a linearly varying first portion 90, representing the constantly increasing charge accumulation on the capacitor $C_4$, which coincides with the constant angle first portion of the periodic signal $V_3$. During the discharge of the capacitor $C_4$ through the constant current drain $I_4$, the waveform $V_4$ linearly decreases from its maximum value, which occurs at a fixed angular point 92 in the ignition cycle, to a point 94.

The ignition system dwell time is initiated at the point 94 in the $V_4$ waveform. For reasons to be explained hereinafter, the high ignition coil secondary voltages ($V_6$) always occur at the end of the ignition cycle, which corresponds to the positive-going zero-crossing point of the input signal $V_{in}$. Therefore, it is apparent that dwell time is initiated when the point 94 is reached and that such dwell time always terminates at a fixed point in the ignition cycle. Thus, the dwell time is the length of time T between the occurrence of the point 94 at the threshold level 100 indicated in the $V_4$ waveform and the end of the ignition cycle. The slope 96 of this voltage waveform, representing the discharge of the capacitor $C_4$ through the constant current drain $I_4$, is constant for all engine speeds within a predetermined range. Preferably, the slope of the waveform portion 96 is chosen such that if it were permitted to continue until a zero voltage level were reached, the zero voltage level would occur at the end 104 of the ignition cycle. Thus, from the broken line portion 98 of the voltage waveform, it may be seen that this is the case. In reality, the diode $D_5$ and resistor $R_{14}$ in conjunction with the comparator $A_2$ cause the voltage to reach zero prior to the end of the ignition cycle, as shown by the solid line portion of the $V_4$ waveform in the region below the threshold level 100. This is designed to insure that the capacitor $C_4$ voltage and charge actually decrease to zero prior to the end of the ignition cycle. However, since the dwell time is initiated at the point 94, the earlier discharge of the capacitor is inconsequential with respect to the dwell time developed by the circuitry 34.

When the portion 96 of the voltage waveform $V_4$ is chosen with a slope that would cause it to reach a zero potential at the end of the ignition cycle, the dwell time signal $V_5$ at the output of the comparator $A_2$ is constant over a range of engine speeds. This occurs because the slope of the second portion 96 of the waveform is developed by the constant current drain and necessarily is independent of engine speed. The point 94 is at a fixed voltage threshold 100, and the dwell time T is equal to the broken line voltage portion 98 multiplied by the cosine of the angle between it and the zero-voltage (ground) reference potential. In other words, the portion 98 is a constant because of the fixed threshold 100 and the angle between this portion and the zero reference level must be constant and independent of engine speed because of the constant slope of the second voltage portion 96. As engine speed increases, the constant dwell time T occupies an ever increasing proportion of the total ignition cycle. Stated another way, the capacitor $C_4$ charges to a voltage level 92 at higher engine speeds which is less than that to which it is charged at low engine speeds, and thus, with the constant discharge rate of the capacitor $C_4$, the point 94 at the threshold level 100 is reached earlier in the ignition cycle than is the case at lower engine speeds. This maintains a constant dwell time.

If the absolute value of the slope of the second portion 96 of the $V_4$ waveform were to be increased such that the end of the broken line portion 98 were to reach the zero reference potential prior to the end 104 of the ignition cycle at which time the high ignition coil secondary voltage occurs, then the dwell time becomes variable to a limited extent. The time between the occurrence of the point 94 at the voltage threshold level 100 and the end of the portion 98 remains constant, but the end of the portion 98 would occur prior to the end 104 of the ignition cycle. The time between the end of the portion 98 and the end of the ignition cycle would then be variable and be inversely proportional to engine speed. In order to avoid problems associated with voltage feedback, the voltage waveform $V_4$ and the charge on the capacitor must reach the zero level prior to the end of the ignition cycle.

The comparator $A_2$ has its positive input at a fixed reference voltage level established by the connection of this input to the common junction formed by the voltage divider consisting of resistors $R_{15}$ and $R_{16}$. This is the threshold voltage level 100 in the $V_4$ voltage waveform. The negative input to the comparator $A_2$ is the $V_4$ voltage signal occurring at the upper terminal of the capacitor $C_4$. When the capacitor voltage is above the threshold level 100, the negative input to the comparator $A_2$ is positive with respect to the threshold potential at the positive input thereto, and the comparator $A_2$ output is very near ground potential. At this time, the transistor $Q_4$ is nonconductive because the voltage signal $V_3$ applied to its base through the resistor $R_{12}$ is low due to the conductive state of the transistor $Q_2$ as previously described. When the negative input to the comparator $A_2$ reaches and then goes slightly below the threshold potential 100 established by the reference voltage applied to the positive input of the comparator $A_2$, the output of the comparator $A_2$ then becomes an open circuit and the voltage $V_5$ at this output then rises to about 3.5 volts. This occurs at the point 102 in the $V_5$ waveform.

When the $V_5$ waveform is at its lower voltage level, the diode $D_5$ is reverse-biased and current cannot flow in the resistor $R_{14}$ and in the diode $D_5$. However, at the point 102 in the $V_5$ waveform, the anode of the diode $D_5$ becomes more positive than its cathode and it conducts to permit current flow therethrough and through the resistor $R_{14}$ into the lead 82 to the constant current drain $I_4$. This increases the current flowing through the lead 82 into the current drain $I_4$ and hence increases the constant current flowing in the lead 86, which must always be very nearly equal to the current in the lead 82. Since the current in the lead 86 is obtained from the capacitor $C_4$, the increased rate of discharge of this capacitor is indicated in the voltage waveform $V_4$ by the sharp drop-off which occurs after the threshold point 94 is reached. This increased capacitor discharge rate insures that its charge and voltage level reach zero prior to the end of the ignition cycle.

The dwell signal $V_5$ goes to its high level at the point 102 as previously described and returns to its low level at the end 104 of the ignition cycle because the transistor $Q_4$ becomes fully conductive at this point due to the rise in the level of the voltage signal $V_3$ which occurs at the end of the ignition cycle and which corresponds to the positive-going zero-crossing point of the input signal $V_{in}$.

The output circuit 36 comprises a pair of transistors $Q_7$ connected in a Darlington configuration. The collection-emitter circuit of the output transistor of the Darlington circuit is connected in series with the ignition coil primary winding 42 and in series with a resistor $R_{29}$. The resistor $R_{29}$ has a very low resistance value. A capacitor $C_7$ is connected at one of its ends to the common collector connections of the Darlington transistors $Q_7$ and has its other terminal connected to the ground lead 64. A pair of zener diodes $D_6$ and $D_7$ are connected in series and between the base and collector electrodes of the input transistor in the pair of Darlington transistors $Q_7$. The base electrode of this input transistor is connected by a lead 106 to the collector of a transistor $Q_6$. The emitter of the transistor $Q_6$ is connected to the ground lead 64 and its collector is connected through a resistor $R_{23}$ to the low-voltage supply lead 58. The base of the transistor $Q_6$ is connected through a current limiting resistor $R_{22}$ to the collector of a transistor $Q_5$ the emitter of which is connected to the junction formed between the Darlington transistors $Q_7$ and the resistor $R_{29}$. The collector of the transistor $Q_5$ also is connected through a resistor $R_{21}$ to the low voltage supply lead 58. The base of the transistor $Q_5$ is connected through a current limiting resistor $R_{19}$ to the output of the comparator $A_2$ at which point the dwell time signal $V_5$ occurs.

When the dwell time signal $V_5$ is at a low voltage level, the transistor $Q_5$ has its base-emitter junction reverse-biased and it is nonconductive. The collector of the transistor $Q_5$ at this time is at a potentional near that of the low-voltage supply lead 58, and the base-emitter junction of the transistor $Q_6$ is forward-biased. This causes the transistor $Q_6$ to be fully conductive and places the lead 106 at very nearly ground potential. Thus, the Darlington transistors $Q_7$ have no base drive and are nonconductive to prevent current flow through the series-connected ignition coil primary winding 42.

When the dwell time signal $V_5$ goes to its high potential level at the point 102, thereby initiating the dwell time, the transistor $Q_5$ has its base-emitter junction forward-biased and is conductive. The collector of the transistor $Q_5$ then is at a low potential rendering the transistor $Q_6$ non-conductive. When the transistor $Q_6$ becomes nonconductive, the voltage at the lead 106 becomes near the low-voltage supply potential, and the Darlington transistors $Q_7$ receive the base drive necessary to render them fully conductive. This causes the current $I_5$ in the ignition coil primary winding 42 to gradually build up to a predetermined level near its maximum. The $I_5$ current waveform is shown in FIG. 2.

The current limiting circuit 38 performs the function of limiting the ignition coil primary winding current $I_5$ to a level at or near its maximum. This circuit comprises a comparator $A_3$ which has its positive input connected to the junction formed between series-connected resistors $R_{24}$ and $R_{26}$. The resistors $R_{24}$ and $R_{26}$ form a voltage divider due to their connection between the low-voltage supply lead 60 and the ground lead 62. Preferably, the reference voltage applied to the positive input to the comparator $A_3$ is about 0.6 volts above ground potential.

A filter capacitor $C_6$ is connected across the positive and negative inputs of the comparator $A_3$. The negative input to the comparator $A_3$ is connected to the junction formed between a resistor $R_{27}$ and a resistor $R_{28}$. The upper terminal of the resistor $R_{27}$ is connected to the low-voltage supply lead 60 and the resistor $R_{28}$ has one of its terminals connected by a lead 108 to the junction formed between the Darlington transistors $Q_7$ and the resistor $R_{29}$ in the output circuit 36. A feedback resistor $R_{25}$ is connected between the output of the comparator $A_3$ and its negative input. Also, the output of the comparator $A_3$ is connected by a lead 110 to the base of the transistor $Q_5$ in the output circuit 36.

The resistors $R_{27}$, $R_{28}$, and $R_{29}$ form a voltage divider. The resistor $R_{29}$ has its value chosen to limit the current in the ignition coil primary winding 42 to a maximum level and has a low ohmic value. The resistors $R_{27}$ and $R_{28}$ are chosen such that the voltage $V_7$, shown in FIG. 2, is maintained at 0.3 volts above ground when there is no current flowing through the resistor $R_{29}$ from the Darlington transistor $Q_7$.

The current limiting circuit 38 may be designed to limit the ignition coil primary winding current $I_5$ to, for example, six amperes. In such case, the resistor $R_{29}$ has a value of 0.05 ohms so that it will have 0.3 volts across it with six ampers flowing through it. As the current in the coil winding gradually builds up to six amperes, the voltage across the resistor $R_{29}$ gradually increases to 0.3 volts. This $R_{29}$ voltage raises the voltage $V_7$ at the negative input to the comparator $A_3$ a similar amount. Thus, voltage $V_7$ increases until it reaches 0.6 volts at a time when the ignition coil primary winding current $I_5$ is 6 amps. Before it reaches 0.6 volts, the voltage $V_7$ applied to the negative input to the comparator $A_3$ is less than the 0.6 reference voltage applied to the positive input thereto. Thus, the output of the comparator is an open circuit at this time and the transistor $Q_5$ is permitted to conduct during the dwell time established by the voltage signal $V_5$, and the transistor $Q_7$ is also conductive at this time permitting the coil current to flow. As the current through the resistor $R_{29}$ builds up to produce the 0.6 volts at the negative input to the comparator $A_3$, the point is reached at which the negative input is more positive than is the reference voltage applied to the positive input to the comparator $A_3$. When this occurs, the comparator output voltage goes to very nearly ground potential. This ground potential is applied through the lead 110 to the base of the transistor $Q_5$ rendering it nonconductive. When the transistor $Q_5$ becomes nonconductive, the transistor $Q_7$ also is rendered nonconductive in the manner previously described. This prevents the flow of ignition coil primary winding current $I_5$ through the transistor $Q_7$ and a further increase in the current $I_5$ is not possible. However, when the transistor $Q_7$ becomes nonconductive, the current $I_5$ can flow into the capacitor $C_7$.

When the transistor $Q_7$ becomes nonconductive, the voltages across the resistor $R_{29}$ immediately decreases, thereby, placing the negative input to the comparator $A_3$ at a voltage level less than the potential at the positive input thereto. This produces a potential on the lead 110 which permits the transistor $Q_5$ to conduct once again and, if the dwell time signal $V_5$ has remained at its high potential level, then the transistor $Q_7$ will be rendered conductive once again. Thus, it is apparent that the current limiting circuit 38 causes the Darlington transistors $Q_7$ to become alternately conductive and nonconductive, thereby, to limit the ignition coil primary current $I_5$ to a maximum level.

The low-engine-speed current-interrupt circuit 40 comprises a comparator $A_4$ used in a voltage follower configuration. The comparator $A_4$ has its negative input connected by a feedback lead 112 to a lead 114 which, in turn, is connected by the lead 110 to the base of the transistor $Q_5$. A current limiting resistor $R_{20}$ is connected between the comparator $A_4$ output and the feedback lead 112. The positive input to the comparator $A_4$ has a resistor $R_{11}$ and a capacitor $C_5$ connected between it and the ground lead 62. A diode $D_4$ has its cathode connected to the comparator $A_4$ positive input and has its anode connected through a resistor $R_8$ to the voltage signal $V_3$ occuring at the collector of the transistor $Q_2$.

As was previously described, the constant-angle voltage $V_3$ consists of a plurality of periodic pulses occupying a fixed fraction of the ignition cycle as represented by the voltage signal $V_{in}$. When the voltage $U_3$ is at its high potential level, the diode $D_4$ is forward-biased and current flows into the capacitor $C_5$. When the electronic ignition system 10 is first energized, the voltage $V_8$ occuring at the positive input to the comparator $A_4$ increases exponentially to about 3.5 volts as indicated in FIG. 2 at the beginning of the first cycle of the $V_8$ waveform, the exponential rise being characteristic of the charging of the capacitor $C_5$ with a current flowing through the resistance $R_8$. When the voltage signal $V_3$ goes to its low potential value, the diode $D_4$ becomes reverse-biased and the capacitor $C_5$ discharges through the resistor $R_{11}$. The time constant formed by the capacitor $C_5$ and the resistor $R_{11}$ is greater than the time constant formed by the resistor $R_8$ and the capacitor $C_5$ and therefore the decay of the voltage $V_8$ during the discharge of the capacitor $C_5$ is less rapid than is its charging. Thus, during each cycle of the periodic voltage waveform $V_3$, the voltage $V_8$ rises by some amount and then decreases less rapidly. The average and minimum levels of voltage $V_8$ achieved is a function of engine speed.

The voltage at the reference negative input to the comparator $A_4$ is applied from the base of the transistor $Q_5$ through the leads 110, 114 and 112. When the Darlington transistors $Q_7$ are conductive permitting current to flow in the ignition coil primary winding 42, the base of the transistor $Q_5$ is at about 0.6 volts. Thus the negative input to the comparator $A_4$ is at this voltage level when current is present in the ignition coil primary winding 42. If the voltage $V_8$ falls below 0.6 volts, then the negative input to the comparator $A_4$ will be greater in voltage than the positive input thereto and the comparator $A_4$ output will go toward ground potential. This ground potential then is applied through the resistor $R_{20}$ and the lead 110 to the base of the transistor $Q_5$ causing it to become nonconductive and thereby rendering the transistor $Q_7$ nonconductive to interrupt current flow in the ignition coil primary winding 42.

The point at which the current interruption occurs is determined by the characteristics of the voltage signal $V_3$ and the values of the RC time constant elements $R_8$, $C_5$ and $R_{11}$. Preferably, the values of these elements and the voltage $V_3$ are such that the voltage $V_8$ falls below 0.6 volts to interrupt the ignition coil primary current when the engine rpm is less than or equal to 30 rpm. This is less than normal engine cranking speed. The interruption of the ignition coil primary current at engine speeds below this level prevents the waste of electrical energy of the DC source of potential 12 in the event the ignition switch 18 is left in the run position when the engine is not in operation or when its speed falls below 30 rpm. The voltage waveform $V_8$ shown in FIG. 2 illustrates the magnitude of this voltage at an engine speed of 600 rpm, well above the level at which primary current interruption occurs due to the action of the circuit 40.

Figure 3:
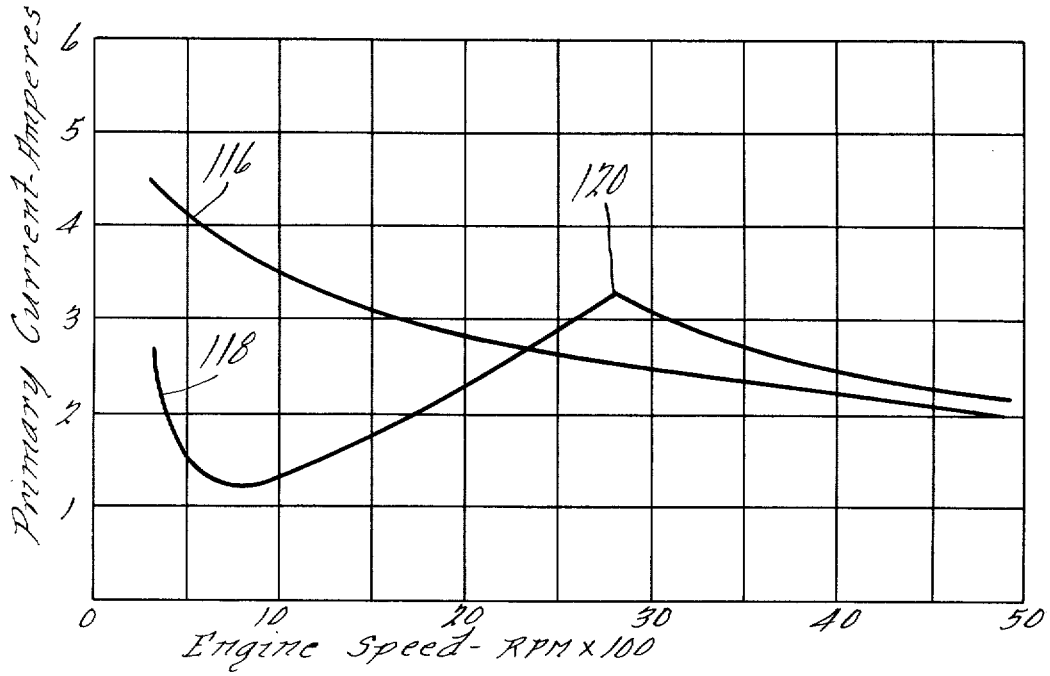
FIG. 3 is a graph of average ignition coil primary current versus engine speed.

With reference now to FIG. 3, there is shown a graph of the average value of the ignition coil primary current $I_5$ versus engine crankshaft rpm. The graph illustrates 116 and 118. The curve 116 illustrates the average ignition coil primary current for an electronic ignition system which substantially duplicates the action of a conventional breaker point ignition system. The curve 118 illustrates the average ignition coil primary winding current $I_5$ of the electronic ignition system 10 of the invention. It may be seen that the electronic ignition system 10 of the invention produces an average ignition coil primary winding current substantially less than the primary current of the ignition system represented by the curve 116 in the range of engine speeds below about 2350 rpm. At engine speeds above this, the curve for the electronic ignition system 110 reaches a peak at the point 120 and then gradually decreases in a manner similar to the decrease in the average current for the curve 116. The peak 120 in the average ignition current occurs at about 2800 rpm. This value of engine speed corresponds to the engine speed at which the point 92 in the voltage waveform $V_4$ coincides with the threshold level 100. Thus, at this engine speed of about 2800 rpm, the ignition system dwell time T occupies the entire time period between the fixed point 122 in the $V_5$ voltage waveform and the end of the ignition cycle 104. The dwell time cannot exceed this period between the fixed point 122 and the end 104 of the ignition cycle because of the action of the transistor $Q_4$ which prevents the start of the dwell time until the voltage signal $V_3$ has dropped to its low potential portion.

From the FIG. 3 current waveform 118, it may be seen that at engine speeds above about 2800 rpm, the average primary winding current is greater than that of the conventional ignition system illustrated by the curve 116. This is desirable because, in this upper engine speed range of the curves, the ignition coil primary current cannot reach its maximum but should be as near that maximum as is possible.

Figure 4:
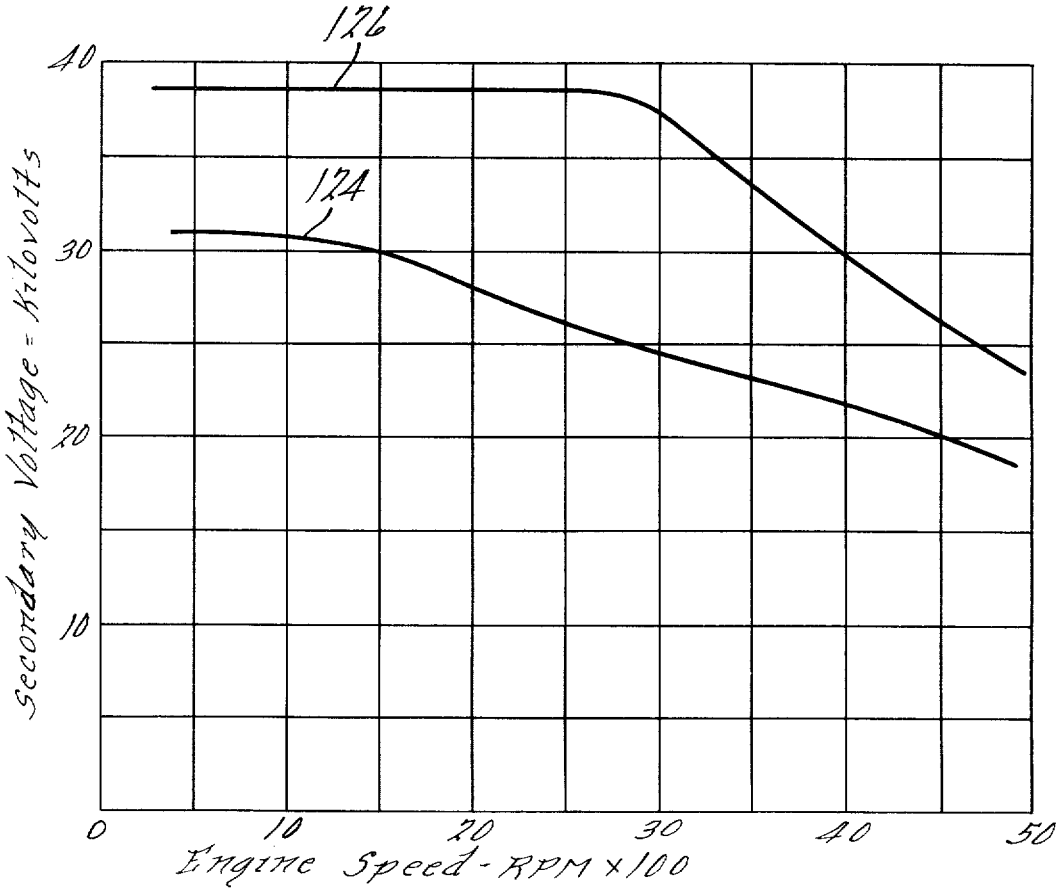
FIG. 4 is a graph of ignition coil secondary voltage versus engine speed.

With reference now to FIG. 4, there is shown a graph of ignition coil secondary voltage in kilovolts versus engine rpm. The graph contains a curve 124 illustrating the secondary voltage achieved in the ignition coil of the ignition system having the primary current illustrated by curve 116 in FIG. 3. FIG. 4 also contains a curve 126 illustrating the secondary voltage achieved with the electronic ignition system 10 of the present invention. It is apparent that the secondary voltage of the conventional ignition system illustrated by the curve 124 drops off rapidly as engine speed increases and that its maximum value is about 31 kilovolts. The ignition system of the present invention, on the other hand, has a maximum value of about 39 kilovolts and this voltage continues over an engine speed range of up to about 2800 rpm. At engine speeds above this level, the electronic ignition system 10 produces a secondary voltage which decreases in a substantially linear manner, but the secondary voltage of this system is still at 30 kilovolts at an engine speed of 4000 rpm, a value close to the maximum secondary voltage achieved by the conventional system.

In summary, the electronic ignition system of the invention produces high secondary voltages while maintaining or increasing ignition coil primary winding current at higher engine speeds and advantageously limiting the average and maximum primary current at lower engine speeds. In the lower engine speed regions, the ignition coil primary winding in the electronic ignition system 10 reaches its desirable maximum current level to provide maximum energy in the sparks produced by the ignition coil, the spark energy being equal to one-half the inductance of the coil times the square of the primary current.

The various voltage levels and the waveforms of FIG. 2 used in the preceding description are obtained with the electronic ignition system 10 having components of the following types or values, these types and values being given here by way of example and not limitation:

Resistor $R_1$ - 100 kilohms
Resistor $R_2$ - 10 kilohms
Resistor $R_3$ - 10 kilohms
Resistor $R_4$ - 68 kilohms
Resistor $R_5$ - 36 kilohms
Resistor $R_6$ - 33 kilohms
Resistor $R_7$ - 4.7 kilohms Resistor $R_8$ - 100 kilohms
Resistor $R_9$ - 30 kilohms
Resistor $R_{10}$ - 82 kilohms
Resistor $R_{11}$ - 3.3 megohms
Resistor $R_{12}$ - 82 kilohms
Resistor $R_{13}$ - 100 kilohms
Resistor $R_{14}$ - 15 kilohms
Resistor $R_{15}$ - 6.2 kilohms
Resistor $R_{16}$ - 1.1 kilohms
Resistor $R_{17}$ - 1 kilohm
Resistor $R_{18}$ - 68 kilohms
Resistor $R_{19}$ - 10 kilohms
Resistor $R_{20}$ - 1 kilohm
Resistor $R_{21}$ - 3.3 kilohms
Resistor $R_{22}$ - 1 kilohm
Resistor $R_{23}$ - 150 ohms
Resistor $R_{24}$ - 22 kilohms
Resistor $R_{25}$ - 20 kilohms
Resistor $R_{26}$ - 3 kilohms
Resistor $R_{27}$ - 22 kilohms
Resistor $R_{28}$ - 1.5 kilohms
Resistor $R_{29}$ - 0.05 ohms
Capacitor $C_1$ - 0.01 microfarad
Capacitor $C_2$ - 0.1 microfarad
Capacitor $C_3$ - 0.22 microfarad
Capacitor $C_4$ - 0.22 microfarad
Capacitor $C_5$ - 0.1 microfarad
Capacitor $C_6$ - 0.01 microfarad
Capacitor $C_7$ - 0.33 microfarad
Zener Diode $D_1$ - IN4734 (reverse breakdown voltage 5.6 volts)
Schottky Diode $D_2$ - MBD101 (Motorola)
Schottky Diode $D_3$ - IN4001
Schottky Diode $D_4$ - IN914
Schottky Diode $D_5$ - IN914
Zener Diodes $D_6$ and $D_7$ - IN5279A (180 volts)
Transistors in current - RCA type CA3096 sources $I_1$, $I_2$ and $I_3$, AE(NPN/PNP transitor-in current drain $I_4$, and array IC) transistors $Q_1$, $Q_2$, $Q_3$, $Q_4$ and $Q_5$
Transistor $Q_6$ - 2N4124
Darlington transistors $Q_7$ - S39711 (Fairchild)
Ignition coil 44:
Primary
210 turns
5.5 millihenry
0.75 ohm
Secondary - 22,000 turns
Comparators $A_1$, $A_2$, $A_3$ - each one-quarter of and A4 LM2901 (National Semiconductor Corporation
Transistor $Q_8$ - MPS-A42 (Motorola)

From the foregoing description of the invention, it is apparent that the electronic ignition system 10 provides a linearly varying voltage which, when it reaches a predetermined voltage threshold, initiates a dwell time that it substantially constant over a range of engine speeds. The circuit uses a voltage input signal $V_{in}$ which is periodic and has a period equal to that of the ignition cycle. Only the zero-crossing points of the input signal $V_{in}$ are utilized by the electronic ignition system.

The fact that only the zero-crossing points of the input signal are used by the ignition system of the invention is an important feature because, within limits, the signal magnitude is of no consequence and neither is the shape of the input waveform provided its zero-crossing points occur at the same points in the ignition cycle over the usable range of engine speeds. This is in sharp contrast to other electronic ignition systems proposed to provide constant dwell time. The use of only the zero-crossing points of the input waveform, rather than using both these points and the magnitude of the voltage input as well, permits much greater manufacturing tolerances in the magnetic pulse generator which supplies the input signal.

The input signal $V_{in}$ described in the foregoing detailed description is an alternating signal. This need not be the case. The electronic ignition system 10 of the invention can operate with a unidirectional voltage input signal. Moreover, an alternating signal having non-equally-spaced zero-crossing points may be utilized by an electronic ignition system constructed in accordance with the invention.

Based upon the foregoing description of the invention, what is claimed is:

1. An ignition system for a spark-ignition internal combustion engine having a direct current potential source and an ignition coil having at least a primary winding, said ignition system comprising:

circuit means for generating a first periodic electrical signal having a period equal to the period of the ignition cycle of said engine, said first electrical signal having a first portion and a second portion;

circuit means for generating a second periodic electrical signal having a period equal to the period of said first electrical signal, said second electrical signal having a first portion, a second portion, and a third portion, said first portion of said second electrical signal coinciding in time with said first portion of said first electrical signal and comprising a linearly varying voltage, said second and third portions of said second electrical signal coinciding in time with said second portion of said first electrical signal, said second portion of said second electrical signal comprising a linearly varying voltage having a slope opposite to the slope of said first portion of said second electrical signal and said third portion of said second electrical signal beginning when said second portion of said second electrical signal has reached a predetermined threshold voltage, said third portion of said second electrical signal ending at the end of said ignition cycle; and circuit means for initiating current flow through said ignition coil primary winding upon the occurrence of said threshold voltage and for interrupting said current flow thereafter;

whereby, voltage generated by the interruption of said ignition coil primary winding current may be used to generate sparks for said engine.

2. An ignition system in accordance with claim 1, wherein said circuit means for generating said first electrical signal comprises circuit means for generating a linearly varying voltage for a fractional portion of said ignition cycle, said fractional portion coinciding in time duration with said first portion of said electrical signal.

3. An ignition system in accordance with claim 1, wherein said circuit means for generating said first electrical signal comprises:

means for producing an alternating signal in timed relation to engine operation, said alternating signal having a period equal to the ignition cycle of said engine;

solid-state switching means for determining when said alternating signal goes above and below a predetermined reference level, said switching means having an input coupled to said alternating signal and having an output which changes from a first state to a second state when said alternating signal crosses said reference level;

a first constant current source;

a second constant current source;

a capacitor coupled between said first and second current sources and having one of its terminals connected to the output of said switching means;

circuit means for causing said first current source to charge said capacitor in one direction when said switching means is in said first state and for causing said capacitor to be charged in the opposite direction from said second current source when said switching device is in said second state.

4. An ignition system in accordance with claim 3, wherein said second constant current source produces a constant current greater in magnitude than the constant current produced by said first constant current source.

5. An ignition system in accordance with claim 1, wherein said circuit means for generating said second electrical signal comprises;

a capacitor;

a first constant current source coupled to said capacitor;

a constant current drain coupled to said capacitor; and circuit means for causing said capacitor to be charged from said first constant current source during said first portion of said first electrical signal and for causing said capacitor to be discharged through said constant current drain during said second portion of said first electrical signal.

6. An ignition system in accordance with claim 5, wherein said circuit means for initiating and interrupting said current flow comprises a switching device connected in series with said ignition coil primary winding and includes circuit means for rendering said switching device conductive when the charge on said capacitor has decreased to a predetermined level.

7. An ignition system in accordance with claim 5, wherein said circuit means for generating said first electrical means comprises:

means for producing an alternating signal in timed relation to engine operation, said alternating signal having a period equal to the ignition cycle of said engine;

switching means for determining when said alternating signal goes above and below a predetermined reference level, said switching means having an input coupled to said alternating signal and having an output which changes from a first state to a second state when said alternating signal crosses said reference level;

a second constant current source;

a third constant current source;

a capacitor coupled between said second and third current sources and having one of its terminals connected to the output of said switching means;

circuit means for causing said second current source to charge said capacitor in one direction when said switching means is in said first state and for causing said capacitor to be charged in the opposite direction from said third current source when said switching device is in said second state.

8. An ignition system in accordance with claim 1, which further comprises circuit means for limiting current in said ignition coil primary winding to a predetermined maximum level.

9. An ignition system in accordance with claim 5, which further comprises circuit means for limiting the current in said ignition coil primary winding to a maximum level.

10. An ignition system in accordance with claim 7, which further includes circuit means for limiting the current in said ignition coil primary winding to a maximum level.

11. An ignition system for a spark-ignition internal combustion engine having a direct current potential source and an ignition coil having at least a primary winding coupled to said direct current potential source, said ignition system comprising:

a solid-state switching device connected in series with said ignition coil primary winding, said solid-state switching device having a conductive state permitting current flow through said ignition coil primary winding and having a nonconductive state preventing current flow through said ignition coil primary winding;

means for generating a periodic electrical signal in timed relation to operation of said engine, said electrical signal having a period equal to the ignition cycle of said engine;

a first capacitor for storing electrical charge;

a first constant current source coupled to said first capacitor;

a constant current drain coupled to said first capacitor;

circuit means for supplying electrical charge at a constant rate to said first capacitor from said constant current source for a predetermined fractional portion of said electrical signal, said circuit means for charging said first capacitor being coupled to said circuit means for generating said electrical signal;

circuit means for discharging said first capacitor through said constant current drain during each period of said electrical signal and after the end of said predetermined fractional portion of said electrical signal during which said first capacitor is charged, said first capacitor being discharged through said constant current drain until the charge on said first capacitor has decreased to a predetermined level;

circuit means for placing said solid-state switching device in its conductive state when said first capacitor has discharged to said predetermined level; and circuit means for placing said solid-state switching device in its nonconductive state at a predetermined point in said electrical signal.

12. An ignition system in accordance with claim 11, wherein said circuit means for supplying electrical charge to said first capacitor from said first constant current source for a predetermined fractional portion of said electrical signal comprises:

a second capacitor;

a second constant current source coupled to said second capacitor;

a third constant current source coupled to said second capacitor; and circuit means, coupled to said circuit means for generating said electrical signal, for causing said second capacitor to be charged in one direction from said second constant current source, for causing said second capacitor to be charged in the opposite direction from said third constant current source after it has been charged in said first direction from said second constant current source, and for causing said first capacitor to be supplied with electrical charge from said first constant current source while said second capacitor is being charged from said third constant current source.

* * * * *